US009261858B2

(12) United States Patent
Satou et al.

(10) Patent No.: US 9,261,858 B2
(45) Date of Patent: Feb. 16, 2016

(54) IMAGE FORMING APPARATUS

(71) Applicant: Konica Minolta, Inc., Chiyoda-ku (JP)

(72) Inventors: Masayuki Satou, Toyohashi (JP); Shigeru Tashiro, Toyokawa (JP); Kuniya Matsuura, Toyohashi (JP); Masahiro Yamaguchi, Toyokawa (JP); Hiroshi Mizuno, Aisai (JP); Shoichi Yoshikawa, Okazaki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/662,948

(22) Filed: Mar. 19, 2015

(65) Prior Publication Data

US 2015/0277372 A1 Oct. 1, 2015

(30) Foreign Application Priority Data

Mar. 20, 2014 (JP) ..... 2014-059057

(51) Int. Cl.
*G03G 21/20* (2006.01)

(52) U.S. Cl.
CPC ..... *G03G 21/206* (2013.01)

(58) Field of Classification Search
CPC ..... G03G 21/20; G03G 21/206
USPC ..... 399/92, 93
See application file for complete search history.

(56) References Cited

U.S. PATENT DOCUMENTS

2008/0038008 A1* 2/2008 Fujita ..... G03G 21/206 399/92
2012/0240534 A1 9/2012 Ryuzaki

FOREIGN PATENT DOCUMENTS

JP 2003-295737 A 10/2003
JP 2011-75997 A 4/2011
JP 2012-203251 A 10/2012

* cited by examiner

*Primary Examiner* — David Bolduc
*Assistant Examiner* — Barnabas Fekete
(74) *Attorney, Agent, or Firm* — Buchanan Ingersoll & Rooney PC

(57) ABSTRACT

An image forming apparatus has: an exhaust air duct capable of forming a first air flow path for an exhaust air cleaning function and a second air flow path for a room air cleaning function, the exhaust air duct having a common use space used in common for the exhaust air cleaning function and the room air cleaning function; a switching member configured to switch a flow path in the exhaust air duct, depending on which of the cleaning functions is activated; a fan configured to discharge air from the common use space in an active state of the exhaust air cleaning function and in an active state of the room air cleaning function; and a control unit configured to control the switching member and to adjust a rotation speed of the fan, depending on which of the cleaning functions is activated.

20 Claims, 13 Drawing Sheets

1, 1A, 1B, 1C

IMAGE FORMING APPARATUS

This application claims benefit of priority to Japanese Patent Application No. 2014-059057 filed Mar. 20, 2014, the content of which is incorporated herein by reference.

BACKGROUND OF THE INVENTION

1. Field of the Invention

The present invention relates to an image forming apparatus, and more particularly to an image forming apparatus having a function to clean the exhaust air therefrom and a function to clean the air in a room where the image forming apparatus is placed.

2. Description of Related Art

Electrophotographic image forming apparatuses typically generate dust (developers, paper powder, etc.), volatile organic compounds, odor and others while operating for image formation. Meanwhile, it has been demanded that image forming apparatuses carry out air cleaning in the offices where the image forming apparatuses are placed. In order to comply with the demand, Japanese Patent Laid-Open Publication No. 2011-75997 suggested an image forming apparatus comprising an interior air cleaner configured to clean the exhaust air from the inside of the image forming apparatus, and an exterior air cleaner configured to suck the air from the outside of the image forming apparatus, clean the air and discharge the cleaned air. In the conventional image forming apparatus, a motor is used in common for a fan of the interior cleaner and a fan of the exterior cleaner, thereby reducing or preventing an increase in the size of the apparatus.

The appropriate air flow rate achieved by the fan of the interior air cleaner and the appropriate air flow rate achieved by the fan of the exterior air cleaner are different. In the conventional image forming apparatus, however, since one motor is used in common for the fan of the interior air cleaner and the fan of the exterior air cleaner, it is difficult to achieve the appropriate air flow rates.

SUMMARY OF THE INVENTION

It is an object of the present invention to provide an image forming apparatus having a function to clean the exhaust air from the image forming apparatus and a function to clean the air in the room where the image forming apparatus is placed and achieving appropriate flow rates of discharged air while preventing an increase in the size of the apparatus.

An image forming apparatus according to a first aspect of the present invention is an image forming apparatus having an exhaust air cleaning function to clean exhaust air emitted from an inside of the image forming apparatus and to discharge the cleaned air, and a room air cleaning function to suck air in a room where the image forming apparatus is placed, to clean the air and to discharge the cleaned air, and the image forming apparatus comprises: an exhaust air duct capable of forming a first air flow path for the exhaust air cleaning function and a second air flow path for the room air cleaning function, the exhaust air duct having a common use space used in common for the exhaust air cleaning function and the room air cleaning function; a switching member configured to switch a flow path in the exhaust air duct, depending on which of the cleaning functions is activated; a fan configured to discharge air from the common use space in an active state of the exhaust air cleaning function and in an active state of the room air cleaning function; and a control unit configured to control the switching member and to adjust a rotation speed of the fan, depending on which of the cleaning functions is activated.

An image forming apparatus according to a second aspect of the present invention comprises: an image forming section configured to form a toner image on a sheet; a fixing device configured to fix the toner image formed by the image forming section on the sheet; a filter; a first duct configured to lead air around the image forming section and the fixing device to the filter; a second duct configured to lead air outside the image forming apparatus to the filter; a fan connected to the first duct and the second duct, the fan configured to cause an air flow in the duct; a switching member configured to switch the air flow caused by the fan to an exhaust air cleaning state wherein air flows mainly from the first duct to the filter or to a room air cleaning state wherein air flows mainly from the second duct to the filter; a setting section configured to set a rotation speed of the fan to a first speed, a second speed higher than the first speed or a third speed higher than the second speed; and a control unit configured to drive the fan in accordance with information sent from the setting section, and, when the image forming section or the fixing device starts operating, to control the switching member and the fan such that the air flow caused by the fan is switched from the room air cleaning state to the exhaust air cleaning state and such that the fan rotates at a fourth speed lower than the second speed.

DETAILED DESCRIPTION OF THE PREFERRED EMBODIMENTS

Figure 1:
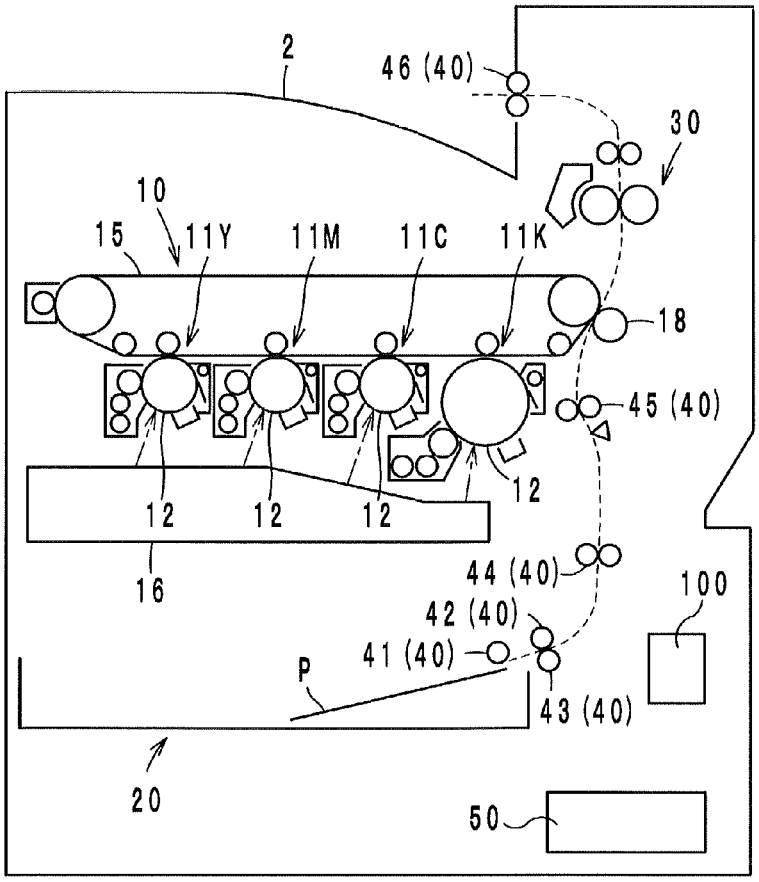
FIG. 1 is a perspective view of an image forming apparatus according to an embodiment.
Figure 1:
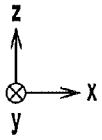

General Structure of Image Forming Apparatus; See FIGS. 1 and 2

In the following, an image forming apparatus 1 according to an embodiment is described with reference to the drawings. In the drawings, the same members and parts are provided with the same reference symbols, and the same descriptions are not repeated.

The image forming apparatus 1 is an electrophotographic color printer. As illustrated in FIG. 1, the image forming apparatus 1 comprises a control unit 100 configured to control the members and the parts of the image forming apparatus 1, an image forming section 10, a sheet feed cassette 20, a fixing device 30, a conveyance section 40, and an air cleaning system 50.

The image forming section 10 includes image forming units 11Y, 11M, 11C and 11K, an intermediate transfer belt 15, a second transfer roller 18, and an exposure unit 16. The image forming units 11Y, 11M, 11C and 11K are configured to form images in colors of Y (yellow), M (magenta), C (cyan) and K (black), respectively, and in each of the image forming units 11Y, 11M, 11C and 11K, a charger, a developing device and others are arranged around a photoreceptor drum 12. Toner images formed in the image forming units 11Y, 11M, 11C and 11K are transferred to the intermediate transfer belt 15 such that the toner images are combined to turn into a composite image (first transfer). The second transfer roller 18 is configured to transfer the composite toner image from the intermediate transfer belt 15 to a sheet P. The exposure unit 16 is configured to carry out exposure with laser beams. The structure and the operation of the image forming section 10 are well known, and a detailed description thereof is omitted.

The sheet feed cassette 20 is a box-like case in which sheets P are stacked. The sheet feed cassette 20 is drawable from the image forming apparatus 1 through a front side (the paper surface of FIG. 1) of the apparatus 1. The presence or non-presence of sheets in the sheet feed cassette 20 is detected by a sensor (not shown). When the cassette 20 becomes empty of sheets, the control unit 100 receives a signal from the sensor, and under control of the control unit 100, a user interface provided on the image forming apparatus 1 displays information that the cassette 20 is empty of sheets.

The conveyance section 40 functions to convey the sheets P in the image forming apparatus 1. The conveyance section 40 includes a pick-up roller 41, a feed roller 42, a separation roller 43, a pair of conveyance rollers 44, a pair of timing rollers 45, and a pair of ejection rollers 46. The topmost sheet P of the stack of sheets in the cassette 20 is picked up by the pick-up roller 41, and the sheet P is fed by the feed roller 42 and the separation roller 43. The fed sheet P is conveyed downstream by the pair of conveyance rollers 44 and is fed to the secondary transfer roller 18 through the pair of timing rollers 45. Then, by an electric field applied from the secondary transfer roller 18, the toner image on the intermediate transfer belt 15 is transferred to the sheet P. Thereafter, the sheet P undergoes a heating treatment in the fixing device 30, and thereby, the toner is fixed on the sheet P. Then, the sheet P is ejected to a printed-sheet tray 2 provided on the upper surface of the image forming apparatus 1 by the pair of ejection rollers 46.

The air cleaning system 50 is configured to clean the exhaust air from the image forming apparatus 1 and to clean the air in the room where the image forming apparatus 1 is placed. A detailed description of the air cleaning system 50 will be given below.

Details of Air Cleaning System; See FIGS. 2-4

Figure 2:
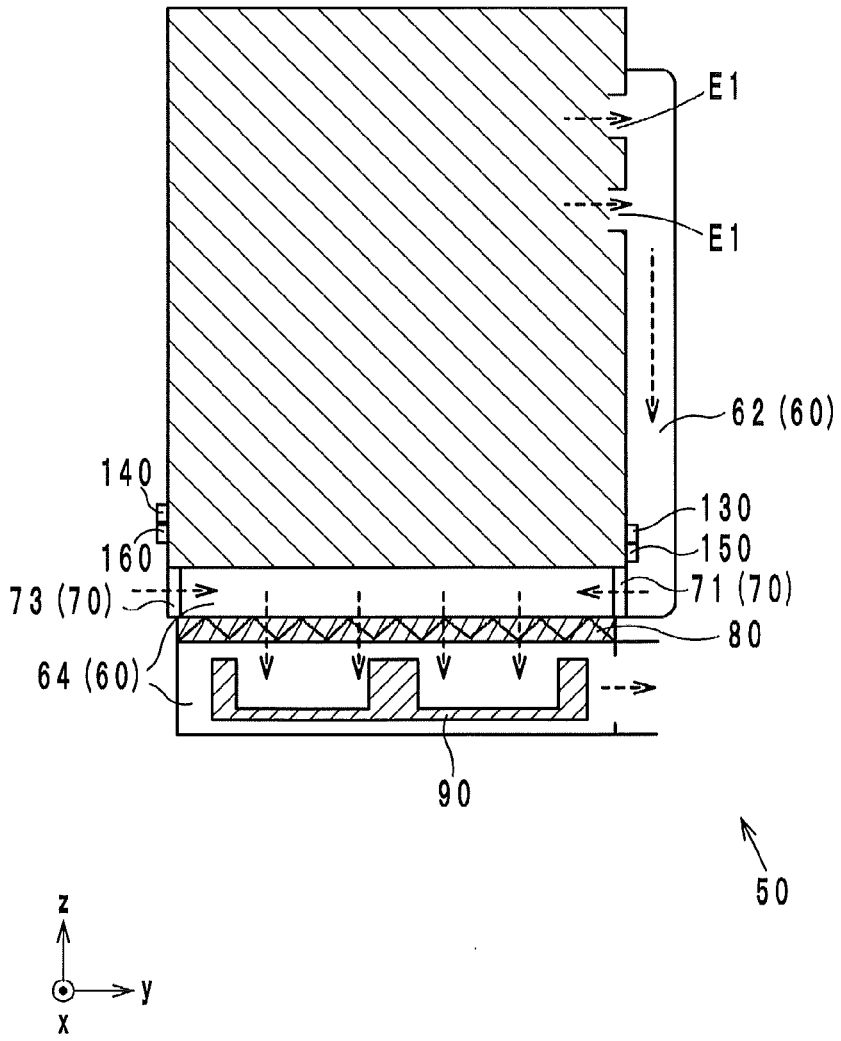
FIG. 2 is a side view of an air cleaning system according to an embodiment when viewed from a side of the image forming apparatus.

The air cleaning system 50 is arranged alongside of the rear and the bottom of the image forming apparatus 1. As illustrated in FIG. 2, the air cleaning system 50 includes an exhaust air duct 60, a switching device 70, an air cleaning filter 80, a fan 90, particulate sensors 130 and 140, and odor sensors 150 and 160.

The exhaust air duct 60 includes an apparatus-side duct 62 extending along the rear portion of the outer frame of the image forming apparatus 1, and a common duct 64 extending along the bottom of the outer frame of the image forming apparatus 1. The duct 62 and the duct 64 are connected to each other at a corner between the rear and the bottom of the image forming apparatus 1 and formed into a monolithic body. When viewed from the right or the left side of the image forming apparatus 1, the exhaust air duct 60 is substantially shaped like an L.

The apparatus-side duct 62 is hollow. The duct 62 has two openings (a first opening and a second opening). The first opening is located in the rear of the image forming apparatus 1, near the image forming section 10, and functions as an exhaust outlet E1. The exhaust air from the image forming section 10 flows into the apparatus-side duct 62 through the exhaust outlet E1. The second opening is connected to the common duct 64, and the exhaust air from the image forming section 10 flows in the apparatus-side duct 62 toward the common duct 64. Thus, the apparatus-side duct 62 constitutes a first flow path for the exhaust air from the image forming section 10.

Figure 3:
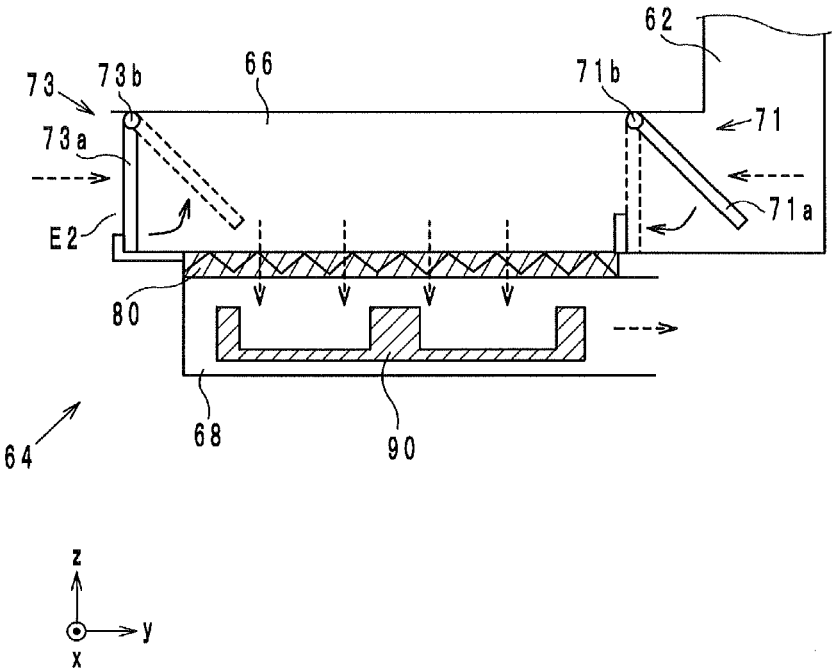
FIG. 3 is a side view of the air cleaning system according to the embodiment when viewed from the side of the image forming apparatus.

The common duct 64 is hollow. As illustrated in FIG. 3, the common duct 64 includes an air inflow duct 66 and a fan-side duct 68.

The air inflow duct 66 has three openings (a first opening, a second opening and a third opening). The first opening is connected to an air inlet E2 located in the front of the image forming apparatus 1. The image forming apparatus 1 takes in the room air through the air inlet E2. The second opening is made in a lower surface, which is near the bottom of the image forming apparatus 1, of the air inflow duct 66, and is connected to the fan-side duct 68. The air coming in through the air inlet E2 flows in the air inflow duct 66 toward the fan-side duct 68. Thus, the air inflow duct 66 of the common duct 64 constitutes a second flow path for the inlet air from the room where the image forming apparatus 1 is placed. The third opening is connected to the apparatus-side duct 62. Accordingly, the exhaust air from the image forming section 10 flows in the apparatus-side duct 62 and comes into the air inflow duct 66 through the third opening. Thus, the air inflow duct 66 is a common use portion where both the exhaust air from the image forming section 10 and the inlet air from the room pass.

The fan-side duct 68 has two openings (a first opening and a second opening). The first opening is connected to the air inflow duct 66 as described above. The second opening faces the rear side of the image forming apparatus 1. Accordingly, the inlet air taken in the inflow duct 66 flows to the fan-side duct 68 and is discharged to the rear side of the image forming apparatus 1.

The switching device 70 includes an apparatus exhaust air valve 71, a room air inlet valve 73, drive motors 75 and 76, and drive gears 77 and 78.

Figure 4:
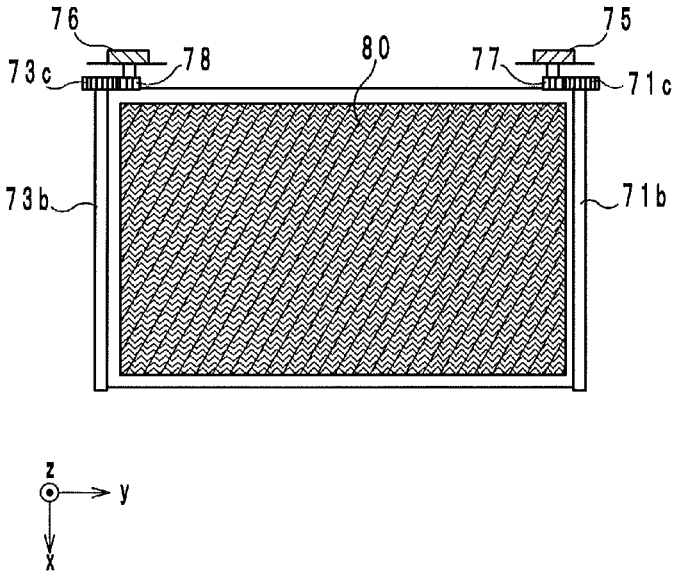
FIG. 4 is a plan view of the air cleaning system according to the embodiment when viewed from the top of the image forming apparatus.

The apparatus exhaust air valve 71 is located near the second opening of the apparatus-side duct 62, and includes a closure plate 71*a* (a first closure plate), a rotary shaft 71*b* and a gear 71*c*. As illustrated in FIG. 3, the closure plate 71*a* is capable of rotating on the rotary shaft 71*b* so as to open and close the flow path for the exhaust air from the image forming section 10. Also, as illustrated in FIG. 4, the gear 71*c* is provided at an end of the rotary shaft 71*b*. In this regard, the axis of rotation of the gear 71*c* is coincident with the axis of rotation of the rotary shaft 71*b*.

The room air inlet valve 73 is located near the first opening of the air inflow duct 66, and includes a closure plate 73*a* (a second closure plate), a rotary shaft 73*b* and a gear 73*c*. As illustrated in FIG. 3, the closure plate 73*a* is capable of rotating on the rotary shaft 73*b* so as to open and close the flow path for the inlet air from the room. Also, as illustrated in FIG. 4, the gear 73*c* is provided at an end of the rotary shaft 73*b*. In this regard, the axis of rotation of the gear 73*c* is coincident with the axis of rotation of the rotary shaft 73*b*.

As illustrated in FIG. 4, the drive motor 75 is provided near the gear 71*c* of the apparatus exhaust air valve 71 so as to drive the closure plate 71*a* via a drive gear 77 connected to the gear 71*c*. The drive motor 76 is provided near the gear 73*c* of the room air inlet valve 73 so as to drive the closure plate 73*a* via a drive gear 78 connected to the gear 73*c*. In this embodiment, the drive sources for the valves 71 and 73 are the drive motors 75 and 76. Alternatively, solenoids may be used as the drive sources for the valves 71 and 73.

As seen in FIG. 3, the air cleaning filter 80 is disposed in the fan-side duct 68 and located upstream from the fan 90. As illustrated in FIG. 4, the air cleaning filter 80 is a porous fiber sheet, such as a non-woven fabric cloth, fitted in a rectangular frame, that is, what is called an air filter. The air cleaning filter 80 is not necessarily a porous fiber sheet as described above. For example, the air cleaning filter 80 may be pleated, and it is not always necessary to use porous fiber as the material of the filter 80.

As seen in FIG. 3, the fan 90 is disposed in the fan-side duct 68. The fan 90 is driven by a motor (not shown in the drawings) to discharge the air from the common duct 64 to the outside of the image forming apparatus 1. In this moment, the exhaust air from the image forming section 10 or the inlet air from the room where the image forming apparatus 1 is placed flows from the air inflow duct 66 to the fan-side duct 68 through the air cleaning filter 80. In this way, the exhaust air from the image forming section 10 or the inlet air from the room where the image forming apparatus 1 is placed is cleaned and emitted.

The particulate sensor 130 is a device configured to monitor the dust in the exhaust air from the image forming section 10. The particulate sensor 130 sends an electric signal indicating the status of the dust to the control unit 100, which will be described later. As seen in FIG. 2, the particulate sensor 130 is located in the apparatus-side duct 61, downstream from the exhaust outlet E1. The particulate sensor 140 is a device configured to monitor the dust in the inlet air from the room where the image forming apparatus 1 is placed. The particulate sensor 140 sends an electric signal indicating the status of the dust to the control unit 100. The particulate sensor 140 is located in the front of the image forming apparatus 1.

The odor sensor 150 is a device configured to monitor the odor in the exhaust air from the image forming section 10. The odor sensor 150 sends an electric signal indicating the status of the odor to the control unit 100, which will be described later. As seen in FIG. 2, the odor sensor 150 is located in the apparatus-side duct 61, downstream from the exhaust outlet E1, beside the particulate sensor 130. The odor sensor 160 is a device configured to monitor the odor in the inlet air from the room where the image forming apparatus 1 is placed. The odor sensor 160 sends an electric signal indicating the status of the odor to the control unit 100. The odor sensor 160 is located in the front of the image forming apparatus 1, beside the particulate sensor 140.

Exhaust Ventilation; See FIG. 5

Figure 5:
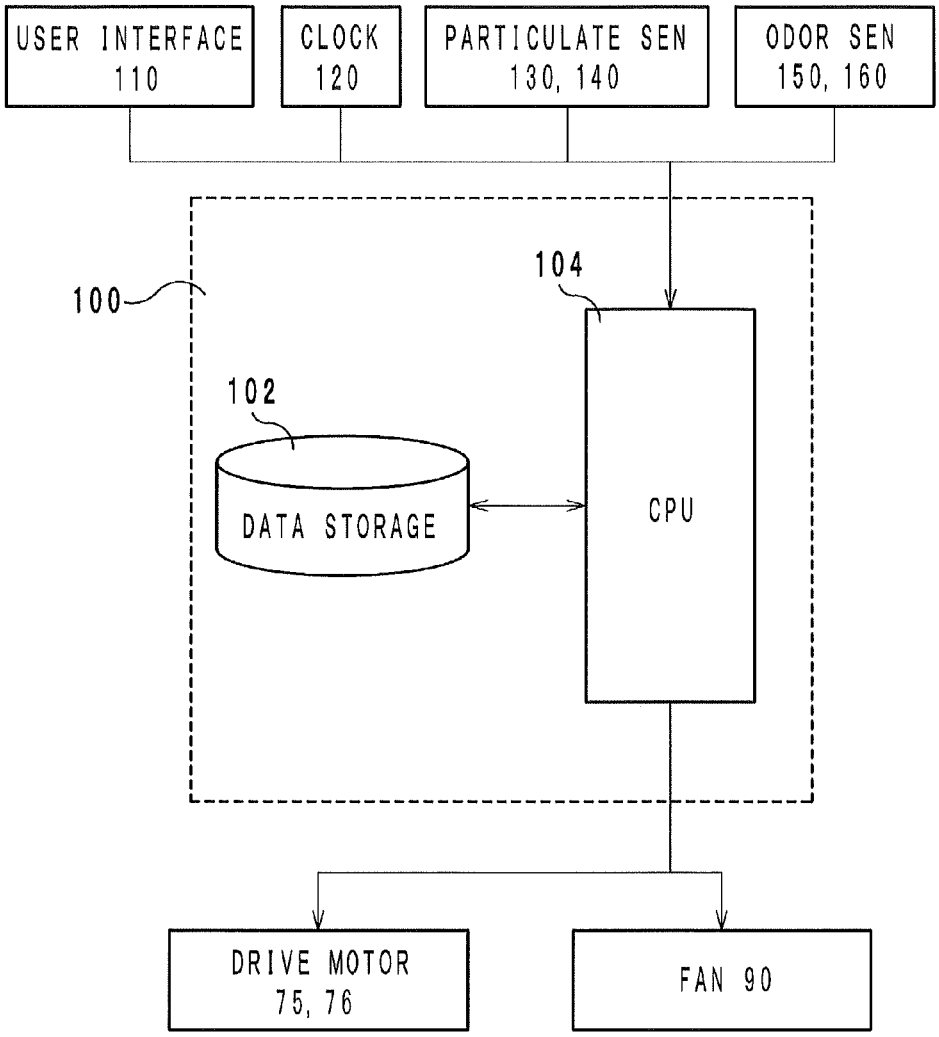
FIG. 5 is a block diagram illustrating a configuration for control of exhaust ventilation.

In the image forming apparatus 1, exhaust ventilation is carried out as illustrated in FIG. 5. Specifically, the control unit 100 activates the drive motors 75 and 76, and the fan 90, based on signals from a user interface 110, a clock 120 provided in the image forming apparatus 1 to indicate the current time, the particulate sensors 130 and 140, and the odor sensors 150 and 160. Thereby, the image forming apparatus 1 appropriately activates the function to clean the air in the room where the image forming apparatus 1 is placed (room air cleaning function) and the function to clean the exhaust air from the image forming apparatus 1 (exhaust air cleaning function). The room air cleaning function and the exhaust air cleaning function are described below.

Figure 6:
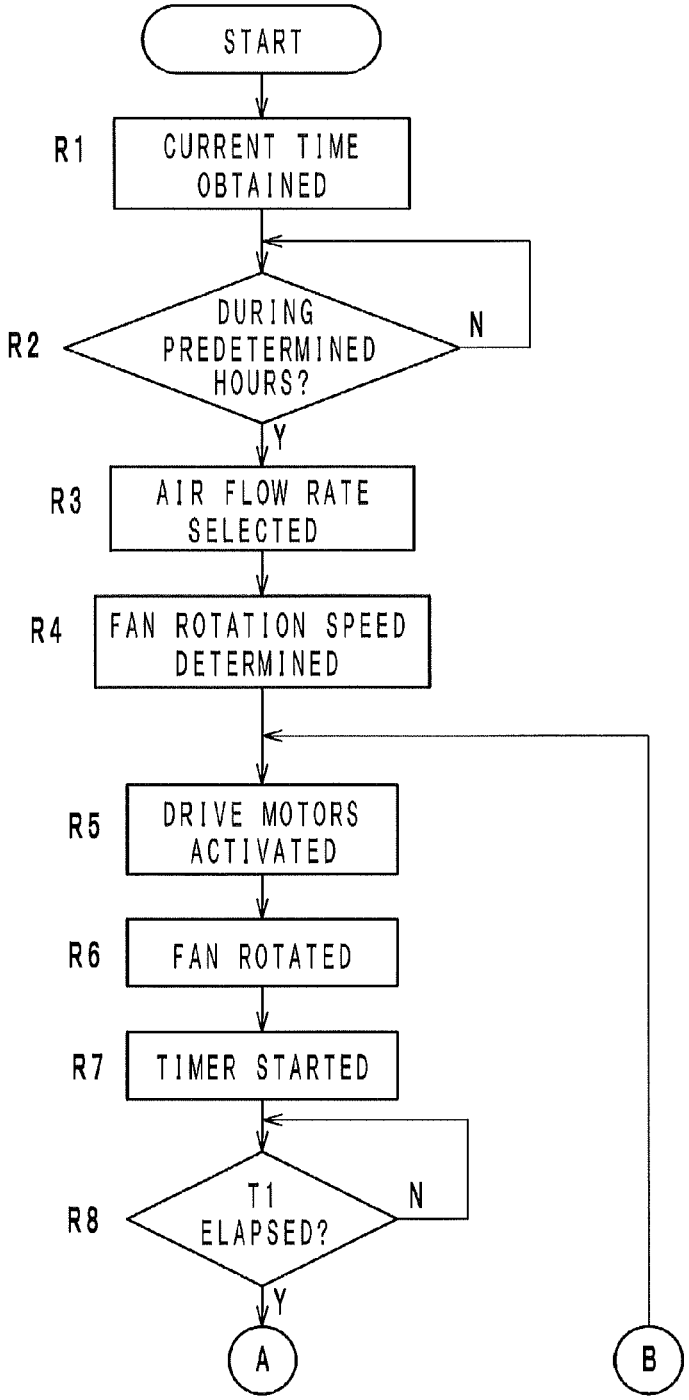
FIG. 6 is a flowchart illustrating control in a room air cleaning mode.
Figure 7:
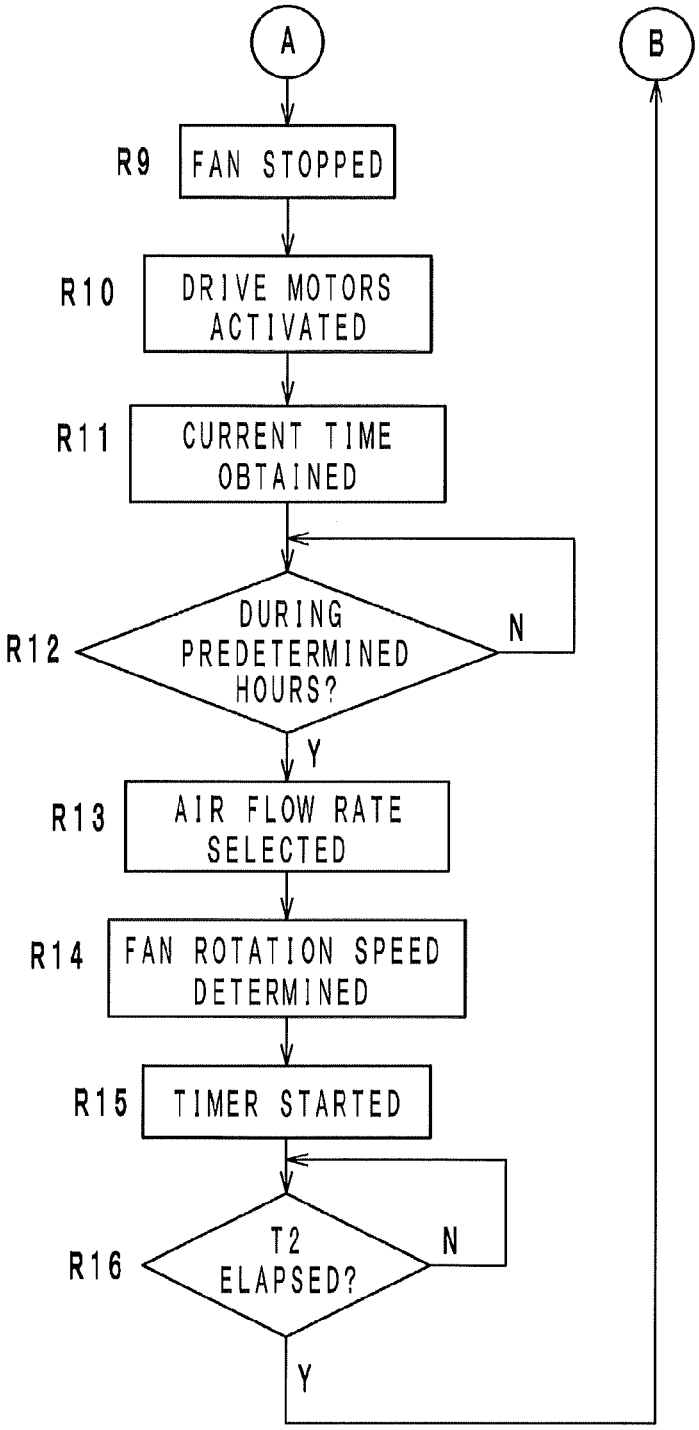
FIG. 7 is a flowchart illustrating control in a room air cleaning mode.

Details of Room Air Cleaning Function; See FIGS. 6 and 7

It is a prerequisite for activation of the room air cleaning function that the main power supply is on. Specifically, when the main power supply of the image forming apparatus 1 is switched on, the control unit 100 starts operation of the image forming apparatus 1 in a room air cleaning mode wherein the image forming apparatus 1 is capable of activating the room air cleaning function. In an inactive state of the room air cleaning function, in principle, the apparatus exhaust air valve 71 is open, and the room air inlet valve 73 is closed. If the image forming section 10 starts operating for preparation of image formation simultaneously with switch-on of the main power supply, the control unit 100 starts operation in an exhaust air cleaning mode, which will be described later.

At step R1 of the room air cleaning mode, the control unit 100 obtains the current time from the clock 120, and the process goes to step R2.

At step R2 of the room air cleaning mode, the control unit 100 determines whether the current time is during predetermined hours. If the control unit 100 determines that the current time is during the predetermined hours, the process goes to step R3. If the control unit 100 determines that the current time is not during the predetermined hours, the process stays at step R2 until it comes into the predetermined hours. The step R2 is, for example, to prevent the image forming apparatus 1 from activating the room air cleaning function when it is not necessary, for example, when there are no people in the room.

At step R3 of the room air cleaning mode, the control unit 100 selects one from a plurality of options listed in a table as the air flow rate to be achieved by the fan 90, in accordance with the signal from the particulate sensor 140, the signal from the odor sensor 160 and a user's choice made at the user interface 110. For example, when the control unit 100 determines, based on the signal from the particulate sensor 140 or the signal from the odor sensor 160, that the degree of dust or the degree of odor is greater than a predetermined reference value, the control unit 100 selects "high" from three options of "high", "medium" and "low" as the air flow rate. However, if the user has chosen one from the options, the control unit 100 determines the air flow rate in compliance with the user's choice. The table listing the plurality of options for the air flow rate is stored in a data storage section 102 of the control unit 100.

At step R4 of the room air cleaning mode, the control unit 100 determines the rotation speed of the fan 90 based on the air flow rate determined at step R3.

At step R5 of the room air cleaning mode, the control unit 100 activates the drive motors 75 and 76. Specifically, the control unit 100 activates the drive motor 75 such that the closure plate 71*a* of the apparatus exhaust air valve 71 closes the apparatus-side duct 62, and at the same time, activates the drive motor 76 such that the closure plate 73*a* of the room inlet air value 73 changes from a closed state to close the air inflow duct 66 to an open state. When the closure plate 71*a* has closed the apparatus-side duct 62, and the closure plate 73*a* of the room air inlet valve 73 has become completely open, the step R5 is completed, and the process goes to step R6. The control unit 100 is informed of the open/close state of the closure plates 71*a* and 73*a* by signals from sensors (not shown in the drawings).

At step R6 of the room air cleaning mode, the control unit 100 activates the fan 90. In this moment, the control unit 100 activates the fan 90 such that the fan 90 rotates at the rotation speed determined at step R4. Thereby, the air in the room where the image forming apparatus 1 is placed flows into the air inflow duct 66 and moves to the fan-side duct 68 through the air cleaning filter 80. Consequently, the air in the room where the image forming apparatus 1 is placed is cleaned. Thus, the room air cleaning function is activated.

At step R7 of the room air cleaning mode, the control unit 100 starts a timer configured to measure a period of time T1. The timer is to time stoppage of the fan 90 based on the time when the fan 90 was started.

At step R8 of the room air cleaning mode, the control unit 100 determines whether the period of time T1 has passed. When the period of time T1 has passed, the process goes to step R9. The process stays at step R8 until the period of time T1 has passed.

At step R9 of the room air cleaning mode, the control unit 100 stops the fan 90. Thereby, the room air cleaning function is stopped.

At step R10 of the room air cleaning mode, the control unit 100 activates the drive motors 75 and 76. Specifically, the control unit 100 activates the drive motor 76 such that the closure plate 73*a* of the room air inlet valve 73 closes the air inflow duct 66. At the same time, the control unit 100 activates the drive motor 75 such that the closure plate 71*a* of the apparatus exhaust air valve 71 changes from a closed state to close the apparatus-side duct 62 to an open state. When the closure plate 73*a* of the room air inlet valve 73 has closed the air inflow duct 66, and the closure plate 71*a* of the apparatus exhaust air valve 71 has become completely open, the step R10 is completed, and the process goes to step R11.

At step R11 of the room air cleaning mode, the control unit 100 obtains the current time from the clock 120, and the process goes to step R12.

At step R12 of the room air cleaning mode, the control unit 100 determines whether the current time is during the predetermined hours. If the control unit 100 determines that the current time is during the predetermined hours, the process goes to step R13. If the control unit 100 determines that the current time is not during the predetermined hours, the process stays at step R12 until it comes into the predetermined hours.

At step R13 of the room air cleaning mode, the control unit 100 selects one of the plurality of options from the table as the air flow rate to be achieved by the fan 90, in accordance with the signal from the particulate sensor 140, the signal from the odor sensor 160 and a user's choice made at the user interface 110.

At step R14 of the room air cleaning mode, the control unit 100 determines the rotation speed of the fan 90 based on the air flow rate determined at step R13.

At step R15 of the room air cleaning mode, the control unit 100 starts a timer configured to measure a period of time T2. The timer is to time a restart of the fan 90 based on the time when the fan 90 was stopped at step R9. The start of the timer at this step R15 is to restart the fan 90 at a predetermined time interval.

At step R16 of the room air cleaning mode, the control unit 100 determines whether the period of time T2 has passed. If the period of time T2 has passed, the process returns to step R5 of the room air cleaning mode and repeats the steps R5 to R16. Thus, in the active state of the room air cleaning function, the fan 90 is driven repeatedly at predetermined time intervals. Then, with switch-off of the main power supply of the image forming apparatus 1, the room air cleaning mode comes to the end.

Figure 8:
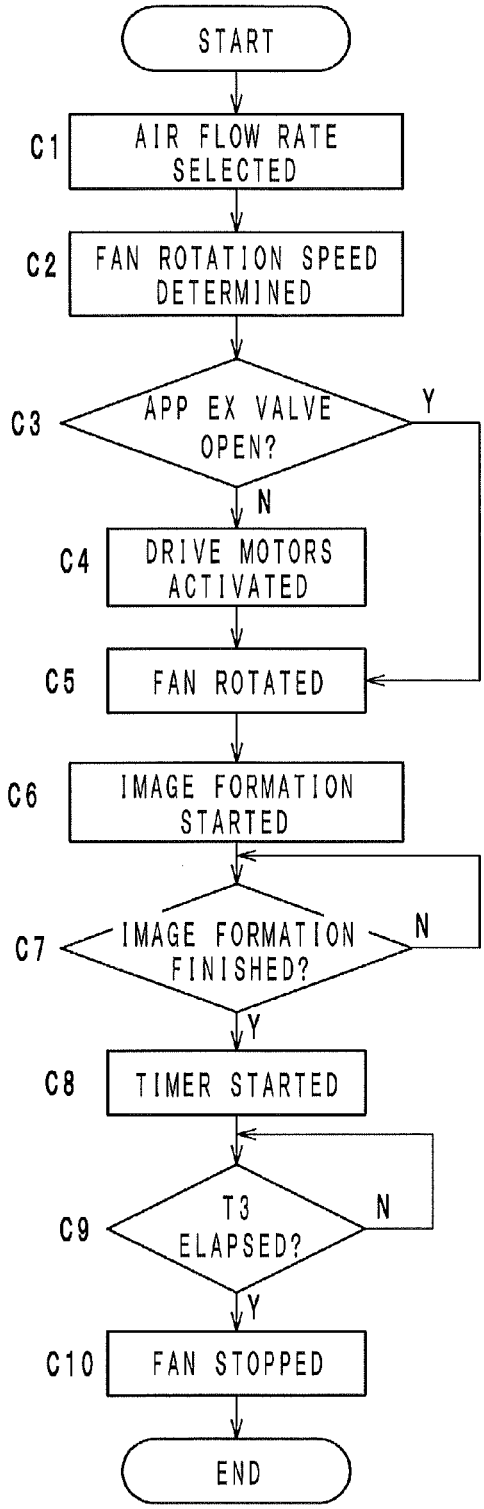
FIG. 8 is a flowchart illustrating control in an exhaust air cleaning mode.

Details of Exhaust Air Cleaning Function; See FIG. 8

When the control unit 100 receives image data from an image reading apparatus or the like connected to the image forming apparatus 1, the control unit 100 starts operation of the image forming apparatus 1 in the exhaust air cleaning mode wherein the image forming apparatus 1 is capable of activating the exhaust air cleaning function before giving a command to form an image in accordance with the image data. During operation in the exhaust air cleaning mode, operation in the room air cleaning mode is cancelled. Specifically, whenever the image forming apparatus 1 receives image data from an image reading apparatus, a personal computer or the like connected thereto, the image forming apparatus 1 operates in the following way. Before giving an image formation command, the control unit 100 changes the operation mode of the image forming apparatus 1 from the room air cleaning mode to the exhaust air cleaning mode. On completion of the image data receiving process, the control unit 100 outputs an image formation command. The output of the image formation command from the control unit 100 is done while the main power supply is on, and therefore, it is a prerequisite for activation of the exhaust air cleaning function that the main power supply is on.

At step C1 of the exhaust air cleaning mode, the control unit 100 selects one of the plurality of options from the table as the air flow rate to be achieved by the fan 90, in accordance with the signal from the particulate sensor 130, the signal from the odor sensor 150 and a user's choice made at the user interface 110. In this moment, the control unit 100 selects a value equal to or lower than the air flow rate that the control unit 100 selects in the room air cleaning mode.

At step C2 of the exhaust air cleaning mode, the control unit 100 determines the rotation speed of the fan 90 based on the air flow rate selected at step C1.

At step C3 of the exhaust air cleaning mode, the control unit 100 checks the open/closed states of the apparatus exhaust air valve 71 and the room air inlet valve 73. If the closure plate 71*a* of the apparatus exhaust air valve 71 is completely open, and the closure plate 73*a* of the room air inlet valve 73 is closed, the process goes to step C5. If not, the process goes to step C4. The control unit 100 determines the open/closed states of the closure plates 71*a* and 73*a* based on signals sent from sensors (not indicated in the drawings).

At step C4 of the exhaust air cleaning mode, the control unit 100 activates the drive motors 75 and 76. Specifically, the control unit 100 activates the drive motor 76 such that the closure plate 73*a* of the room air inlet valve 73 closes the air inflow duct 66. At the same time, the control unit 100 activates the drive motor 75 such that the closure plate 71*a* of the apparatus exhaust air valve 71 becomes completely open. When the room air inlet valve 73 is closed, and the apparatus exhaust air valve 71 becomes completely open, the step C4 is completed, and the process goes to step C5.

At step C5 of the exhaust air cleaning mode, the control unit 100 starts the fan 90. In this moment, the control unit 100 drives the fan 90 such that the fan 90 rotates at the rotation speed determined at step C2. Thereby, the exhaust air from the image forming section 10 flows to the fan-side duct 68 through the apparatus-side duct 62 and the air inflow duct 66, and the air is released. In the meantime, the exhaust air from the image forming section 10 passes through the air cleaning filter 80 and thereby is cleaned. Thus, the exhaust air cleaning function is activated.

At step C6 of the exhaust air cleaning mode, the control unit 100 outputs an image formation command to start an image forming operation.

At step C7 of the exhaust air cleaning mode, the control unit 100 determines whether all of the sheets undergoing the image forming operation have been ejected, that is, whether the image forming operation has finished. If the image forming operation has finished, the process goes to step C8. The process stays at step C7 until the image forming operation has finished.

At step C8 of the exhaust air cleaning mode, the control unit 100 starts a timer configured to measure a period of time T3. The timer is to time stoppage of the fan 90 based on the time when the image forming operation finished. By keeping rotating the fan 90 for a predetermined time even after completion of an image forming operation, it is possible to clean exhaust air from the image forming section 10 and to cool the image forming section 10.

At step C9 of the exhaust air cleaning mode, the control unit 100 determines whether the period of time T3 has passed. When the period of time T3 has passed, the process goes to step C10. The process stays at step C10 until the time T3 has passed.

At step C10 of the exhaust air cleaning mode, the control unit 100 stops the motor connected to the fan 90. With this motion, the exhaust air cleaning mode finishes, and the image forming apparatus 1 returns to the room air cleaning mode.

Advantageous Effects

In the image forming apparatus 1, the air inlet duct 66 and the fan-side duct 68 of the exhaust air duct 60 are used both in the active state of the exhaust air cleaning function and in the active state of the room air cleaning function. In other words, a part of the exhaust air duct 60 is used in common for the exhaust air cleaning function and for the room air cleaning function. In the image forming apparatus 1, the fan 90 is also used in common for the exhaust air cleaning function and for the room air cleaning function. These reduce or prevent an increase in the size of the image forming apparatus 1. Further, depending on the activated cleaning function, the control unit 100 switches the flow path in the exhaust air duct 60 by controlling the switching device 70, and changes the rotation speed of the fan 90. Accordingly, it is possible to achieve an air flow rate appropriate for each of the cleaning functions.

In the image forming apparatus 1, the air flow rate selected in the exhaust air cleaning mode is lower than the air flow rate selected in the room air cleaning mode. Accordingly, the exhaust air emitted from the image forming section 10 passes through the air cleaning filter 80 more slowly. Consequently, compared with a case where the air flow rate in the active state of the exhaust air cleaning function and the air flow rate in the active state of the room air cleaning function are substantially equal to each other, the air cleaning filter 80 traps more particulates from the exhaust air from the image forming section 10.

In the image forming apparatus 1, at the second step R2 of the room air cleaning mode, the control unit 100 determines whether the current time is during predetermined hours, and based on the result of the determination, the control unit 100 determines whether to activate the room air cleaning function. With this control, for example, it is possible to prevent activation of the room air cleaning function when it is not necessary, for example, when there are no people in the room where the image forming apparatus 1 is placed.

First Modification; See FIG. 9

An image forming apparatus 1A according to a first modification is different from the image forming apparatus 1 in the parts structure and the mechanism of the switching device 70.

In the switching device 70 of the image forming apparatus 1A, springs 150 and 152 are used instead of the drive motors 75 and 76 and the drive gears 77 and 78.

Figure 9:
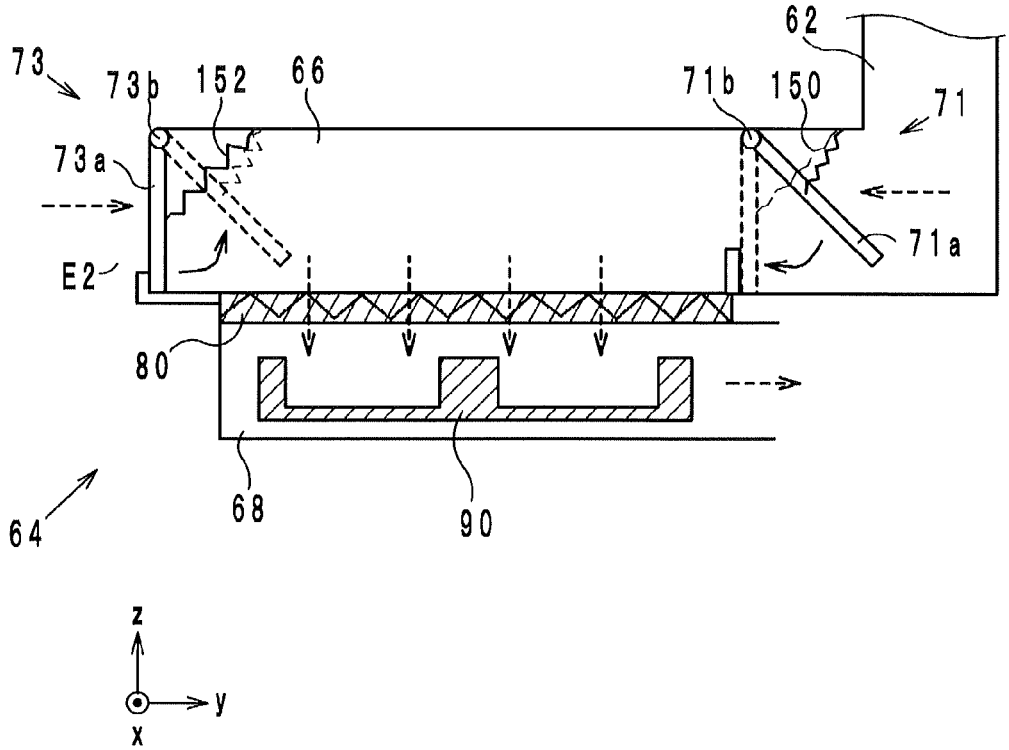
FIG. 9 is a side view of an air cleaning system according to a first modification when viewed from a side of the image forming apparatus.

As seen in FIG. 9, one end of the spring 150 is connected to the closure plate 71*a* of the apparatus exhaust air valve 71, and the other end of the spring 150 is fixed to the inner wall of the apparatus-side duct 62. The closure plate 71*a* is pulled by the spring 150 in a direction to open the apparatus exhaust air valve 71.

One end of the spring 152 is connected to the closure plate 73*a* of the room air inlet valve 73, and the other end of the spring 152 is fixed to the inner wall of the air inflow duct 66. The closure plate 73*a* is pushed by the spring 152 against a stopper provided on the inner wall of the air inflow duct 66 so as to close the air inlet valve 73.

The switching device 70 of the image forming apparatus 1A acts as follows. While neither of the cleaning functions is activated, the apparatus exhaust air valve 71 is open, and the room air inlet valve 73 is closed. In the active state of the exhaust air cleaning function, also, the apparatus exhaust air valve 71 is open, and the air inlet valve 73 is closed. When the room air cleaning function is activated, a negative pressure caused by exhaust ventilation achieved by rotation of the fan 90 generates a force greater than the pulling force of the spring 150, and the apparatus exhaust air valve 71 is closed. Also, the negative pressure caused by exhaust ventilation achieved by rotation of the fan 90 generates a force greater than the pushing force of the spring 152, and the air inlet valve 73 opens. This is because the air flow rate in the active state of the room air cleaning function is greater than the air flow rate in the active state of the exhaust air cleaning function, that is, because the negative pressure caused by rotation of the fan 90 in the active state of the room air cleaning function is greater than the negative pressure caused by rotation of the fan 90 in the exhaust air cleaning function.

In the image forming apparatus 1A having the structure above, the springs 150 and 152 are used instead of the drive motors 75 and 76 and the drive gears 77 and 78, and the flow path in the exhaust air duct 60 is switched by use of the negative pressure caused by rotation of the fan 90. Thus, the image forming apparatus 1A does not need a dedicated drive source for the switching device 70, and it is possible to reduce or prevent an increase in the apparatus size and an increase in the cost.

All the parts other than the switching device 70 of the image forming apparatus 1A are similar to those of the image forming apparatus 1. The descriptions of the parts other than the switching device 70 of the image forming apparatus 1 are applicable to those parts of the image forming apparatus 1A.

Second Modification; See FIG. 10

An image forming apparatus 1B according to a second modification is different from the image forming apparatus 1 in further comprising another air cleaning filter 82 provided in the apparatus-side duct 62.

Figure 10:
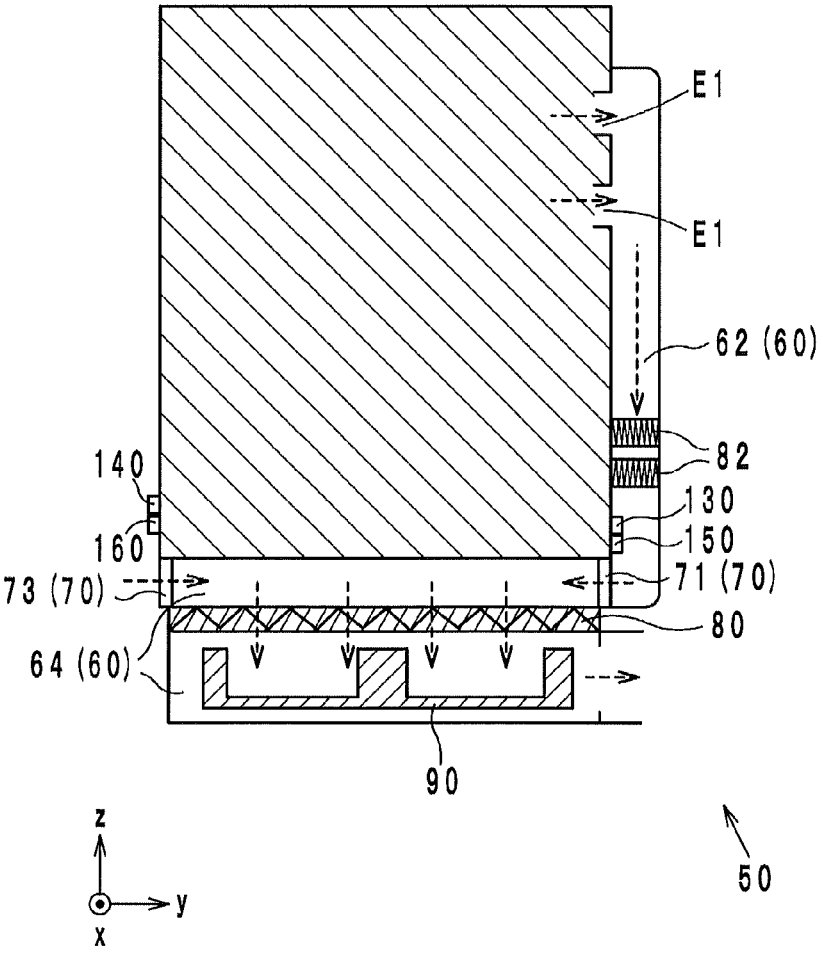
FIG. 10 is a side view of an air cleaning system according to a second modification when viewed from a side of the image forming apparatus.

In the image forming apparatus 1B, as illustrated in FIG. 10, the air cleaning filter 82 is provided in the apparatus-side duct 62, and therefore, certain particulates in the exhaust air from the image forming apparatus 1 are trapped more. Since the air cleaning filter 82 is provided in the apparatus-side duct 62, this cleaning filter 82 is not used in the active state of the room air cleaning function. This prolongs the life of the air cleaning filter 82 in the image forming apparatus 1B. The air cleaning filter 82 is, for example, an activated carbon filter.

The image forming apparatus 1B is similar to the image forming apparatus 1 except that the exhaust air cleaning filter 82 is further provided in the image forming apparatus 1B. The description of the image forming apparatus 1 is applicable to the image forming apparatus 1B.

Third Modification; See FIGS. 11-13

An image forming apparatus 1C according to a third modification is different from the image forming apparatus 1 in the following point. While in the image forming apparatus 1, the air flow rate is automatically set in accordance with an output from the sensor, in the third modification, the user inputs the air flow rate manually at an operation panel (not illustrated in the drawings). A detailed description is given below.

Figure 11:
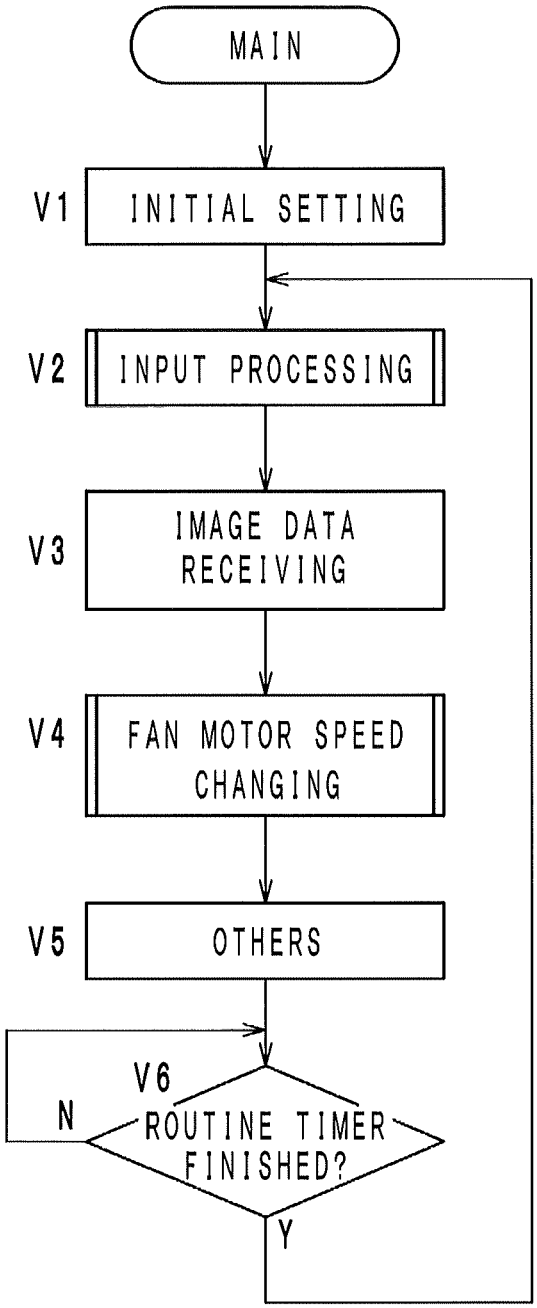
FIG. 11 is a main routine for a room air cleaning function and an exhaust air cleaning function.

FIG. 11 indicates a main routine for controlling the image forming apparatus 1C in the active state of the room air cleaning function or in the active state of the exhaust air cleaning function. At step V1 of the main routine, the control unit 100 carries out initial setting so as to reset various flags, timers, counters, etc.

At step V2, the control unit 100 carries out a subroutine for processing input data from the user about, the air flow rate for the room air cleaning function.

At step V3, the control unit 100 receives and processes image data from an image reading apparatus (not illustrated in the drawings) connected to the image forming apparatus 1C.

At step V4, the control unit 100 carries out a subroutine for changing the rotation speed of a fan motor configured to drive the fan 90 and switching the flow path.

At step V5, the control unit 100 carries out other processing for starts and stops of the devices and the members included in the image forming apparatus 1C.

At step V6, the control unit 100 measures a period of time with a routine timer so that the control unit 100 can carry out the process from step V2 to step V5 at intervals of a predetermined time. Every time the routine timer finishes measuring the period of time, the control unit 100 restarts the process.

The process is repeated again and again in the main routine for controlling the image forming apparatus 1C in the active state of the room air cleaning function or in the active state of the exhaust air cleaning function.

Figure 12:
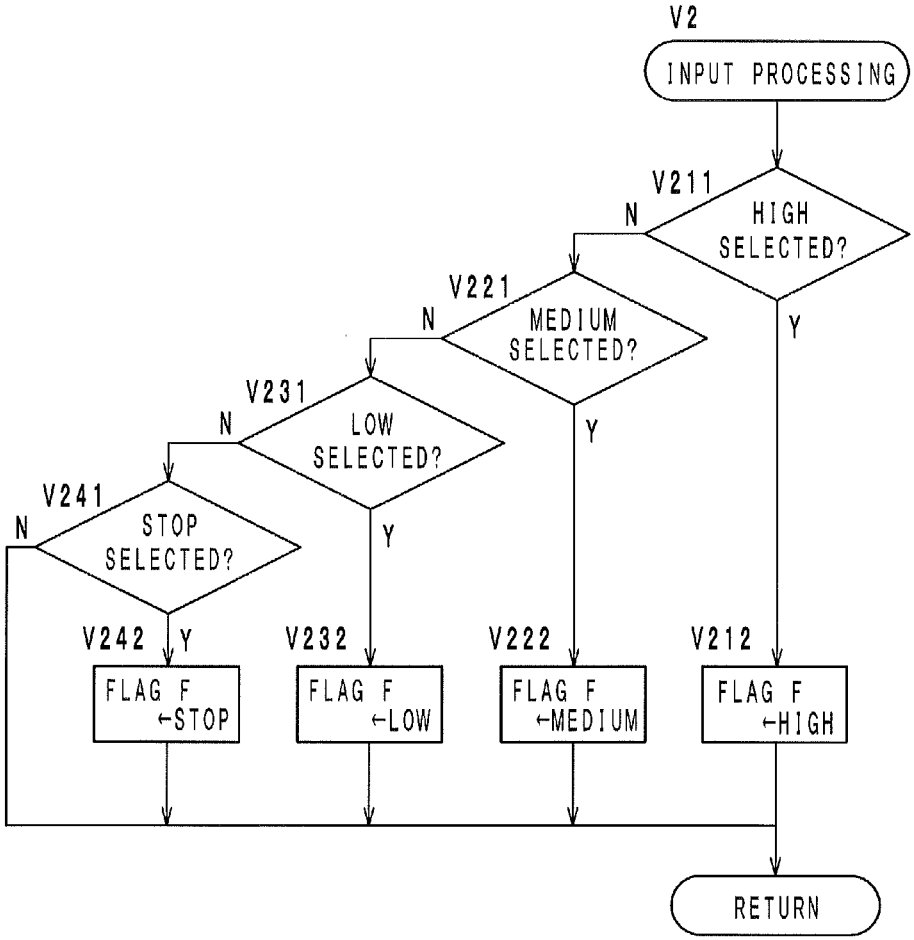
FIG. 12 is a subroutine for setting the air flow rate in an active state of the room air cleaning function.

Next, with reference to FIG. 12, the input data processing at step V2 is described in more detail. The step V2 is a subroutine for setting the air flow rate for the room air cleaning function. At step V2, the control unit 100 changes the flag for air flow rate stored in the storage section M.

At a first step V211 of the input data processing subroutine, the control unit 100 determines whether the user has selected "high" from the three options of "high", "medium" and "low" as the air flow rate for the room air cleaning function. If the user has selected "high", the control unit 100 changes the flag F for air flow rate stored in the storage section M to a value corresponding to a high air flow rate at step V212, and the process returns to the main routine. If the user has not selected "high", the process in the subroutine goes to step V221.

At step V221 of the input data processing subroutine, the control unit 100 determines whether the user has selected "medium" as the air flow rate for the room air cleaning function. If the user has selected "medium", the control unit 100 changes the flag F to a value corresponding to a medium air flow rate at step V222, and the process returns to the main routine. If the user has not selected "medium", the process in the subroutine goes to step V231.

At step V231 of the input data processing subroutine, the control unit 100 determines whether the user has selected "low" as the air flow rate for the room air cleaning function. If the user has selected "low", the control unit 100 changes the flag F to a value corresponding to a low air flow rate at step V232, and the process returns to the main routine. If the user has not selected "low", the process in the subroutine goes to step V241.

At step V241 of the input data processing subroutine, the control unit 100 determines whether the user has selected "stop" as the air flow rate for the room air cleaning function. If the user has selected "stop", the control unit 100 changes the flag F to a value corresponding to a stop at step V242, and the process returns to the main routine. If the user has not selected "stop", the process returns to the main routine with the flag F unchanged.

Figure 13:
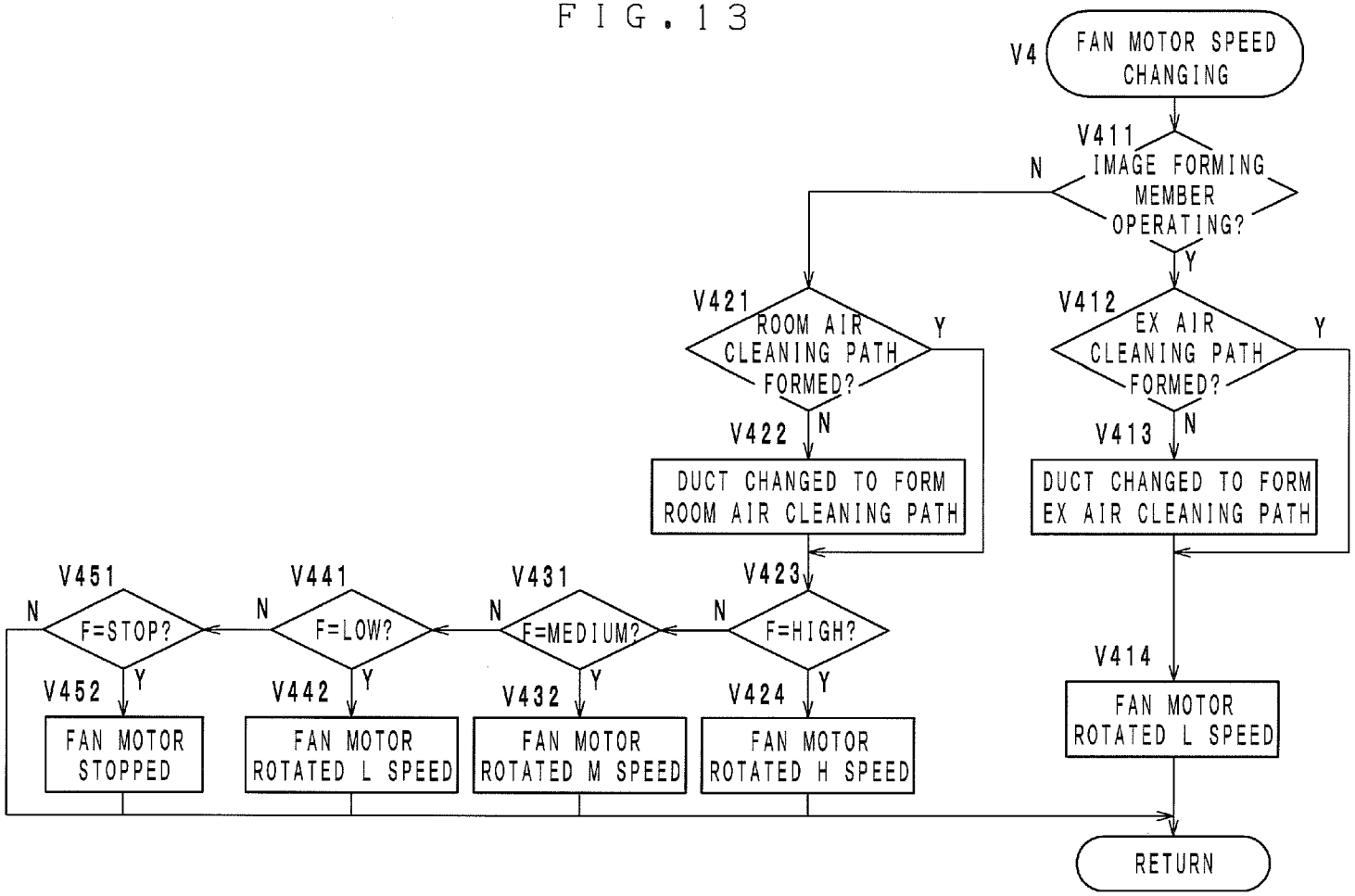
FIG. 13 is a subroutine for setting the rotation speed of a fan motor and rotating the fan motor.

Next, with reference to FIG. 13, the fan motor changing at step V4 is described in more detail. Step V4 is a subroutine for setting the rotation speed of the fan motor connected to the fan 90 and rotating the fan motor in accordance with the flag F stored in the storage section M.

At a first step V411 of the fan motor changing subroutine, the control unit 100 determines whether the image forming section 10, the fixing device 30 or any other device or member relating to image formation is about to start/is operating in response to switch-on of the power supply of the image forming apparatus 1C or switch-on of a print switch. Whether any device or member relating to image formation is about to start is determined based on whether the control unit 100 has received image data from the image reading apparatus (not illustrated in the drawings) connected to the image forming apparatus 1C. If any device or member relating to image formation is about to start or is operating, the process of this subroutine goes to step V412, and if none of the devices and members relating to image formation is about to start or is operating, the process of this subroutine goes to step V421.

At step V412, the control unit 100 determines whether a flow path for the exhaust air cleaning function is formed, that is, whether the apparatus exhaust air valve 71 is open and whether the room air inlet valve 73 is closed. If the flow path is not formed, the process of this subroutine goes to step V413, and if the flow path is formed, the process of this subroutine goes to step V414.

At step V413, the control unit 100 starts the drive motors 75 and 76. Specifically, the drive motor 76 is activated so that the closure plate 73*a* of the room air inlet valve 73 closes the air inflow duct 66, and at the same time, the drive motor 75 is activated so that the closure plate 71*a* of the apparatus exhaust air valve 71 becomes completely open. When it comes to the stage where the room air inlet valve 73 is closed and the apparatus exhaust air valve 71 is completely open, step V413 is completed, and the process goes to step V414.

At step V414, the control unit 100 rotates the fan 90 at a low speed via the fan motor. Thereafter, the process returns to the main routine. Further, when the process comes to this subroutine again, if the devices and members relating to image formation, such as the image forming section 10 and the fixing device 30, are stopped, the process goes from step V411 to step V421, and the image forming apparatus 1C comes to the room air cleaning mode.

At step V421, the control unit 100 determines whether a flow path for the room air cleaning function is formed, that is, whether the apparatus exhaust air valve 71 is closed and whether the room air inlet valve 73 is open. If the flow path is not formed, the process of this subroutine goes to step V422, and if the flow path is formed, the process of this subroutine goes to step V423.

At step V422, the control unit 100 starts the drive motors 75 and 76. Specifically, the drive motor 75 is activated so that the closure plate 71*a* of the apparatus exhaust air valve 71 closes the apparatus-side duct 62, and at the same time, the drive motor 76 is activated so that the closure plate 73*a* of the room air inlet valve 73 changes from a closed state to close the air inflow duct 66 to an open state. When it comes to the stage where the closure plate 71*a* closes the apparatus-side duct 62 and the closure plate 73*a* of the room air inlet valve 73 is completely open, step V422 is completed, and the process goes to step V423.

At step V423, the control unit 100 determines whether the user has selected "high", in the input data processing subroutine at step V2, as the air flow rate for the room air cleaning function. If "high" has been selected, the process of this subroutine goes to step V424, and if "high" has not been selected, the process of this subroutine goes to step V431.

At step V424, the control unit 100 rotates the fan 90 at a high speed via the fan motor. Thereafter, the process returns to the main routine.

At step V431, the control unit 100 determines whether the user has selected "medium", in the input data processing subroutine at step V2, as the air flow rate for the room air cleaning function. If "medium" has been selected, the process of this subroutine goes to step V432, and if "medium" has not been selected, the process of this subroutine goes to step V441.

At step V432, the control unit 100 rotates the fan 90 at a medium speed via the fan motor. Thereafter, the process returns to the main routine.

At step V441, the control unit 100 determines whether the user has selected "low", in the input data processing subroutine at step V2, as the air volume for the room air cleaning function. If "low" has been selected, the process of this subroutine goes to step V442, and if "low" has not been selected, the process of this subroutine goes to step V451.

At step V442, the control unit 100 rotates the fan 90 at a low speed via the fan motor. Thereafter, the process returns to the main routine.

At step V451, the control unit 100 determines whether the user has selected "stop", in the input data processing subroutine at step V2, as the air flow rate for the room air cleaning function. If "stop" has been selected, the process of this subroutine goes to step V452, and the fan 90 is stopped. If the user has not made any selections in the input data processing subroutine, the fan 90 is kept in the current state, that is, in a rotating state or in a stopping state, and the process returns to the main routine.

All the parts other than the control routine for the room air cleaning function and the exhaust air cleaning function of the image forming apparatus 1C are similar to those of the image forming apparatus 1. The descriptions of these parts of the image forming apparatus 1 are applicable to those of the image forming apparatus 1C. In this embodiment, the image forming apparatus is controlled such that the air flow rate for the exhaust air cleaning function is the lowest, and therefore, particulates generated by the fixing device and the developing devices can be certainly trapped.

Other Embodiments

Figure 14:
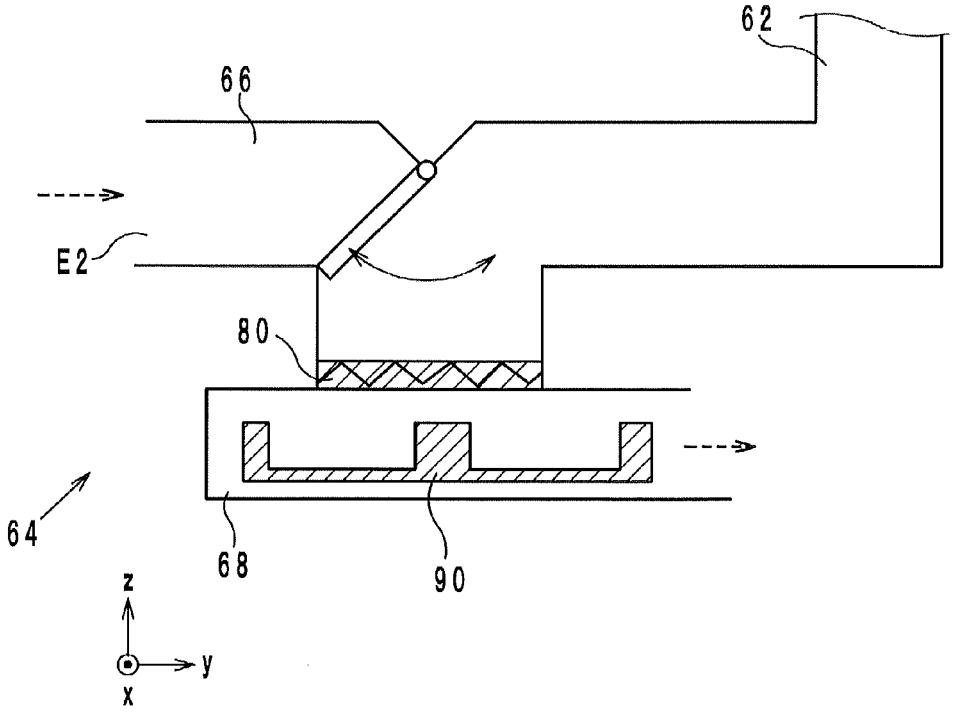
FIG. 14 is a side view of an air cleaning system according to another embodiment when viewed from a side of the image forming apparatus.

The shape of the exhaust air duct, the positions of the particulate sensors and the odor sensors, and the mechanism of the switching device may be arbitrarily designed. For example, the exhaust air duct may be designed as illustrated in FIG. 14. In the structure illustrated in FIG. 14, the apparatus-side duct 62 and the air inflow duct 66 are completely divided from each other, and the fan-side duct 68 is connected to the ducts 62 and 66 such that these three ducts 62, 66 and 68 are joined at a junction. Further, a valve is provided at the junction of the three ducts 62, 66 and 68 such that the valve is capable of closing one of the apparatus-side duct 62 and the air inflow duct 66.

In the embodiment above, the room air cleaning function is activated automatically after the elapse of a certain period of time. However, the room air cleaning function may be activated or inactivated in response to an input by a user through the user interface.

Although the present invention has been described in connection with the preferred embodiments above, it is to be noted that various changes and modifications may be obvious to persons having ordinary skill in the art. Such changes and modifications are to be understood as being within the scope of the present invention.

What is claimed is:

1. An image forming apparatus having an exhaust air cleaning function to clean exhaust air emitted from an inside of the image forming apparatus and to discharge the cleaned air, and a room air cleaning function to suck air in a room where the image forming apparatus is placed, to clean the air and to discharge the cleaned air, the image forming apparatus comprising:

an exhaust air duct capable of forming a first air flow path for the exhaust air cleaning function and a second air flow path for the room air cleaning function, the exhaust air duct having a common use space used in common for the exhaust air cleaning function and the room air cleaning function;

a switching member configured to switch a flow path in the exhaust air duct, depending on which of the cleaning functions is activated;

a fan configured to discharge air from the common use space in an active state of the exhaust air cleaning function and in an active state of the room air cleaning function; and a control unit configured to control the switching member and to adjust a rotation speed of the fan, depending on which of the cleaning functions is activated.

2. The image forming apparatus according to claim 1, wherein the switching member is a valve provided in the exhaust air duct.

3. The image forming apparatus according to claim 1, further comprising an air cleaning filter used in common for the exhaust air cleaning function and for the room air cleaning function.

4. The image forming apparatus according to claim 1, wherein the exhaust air cleaning function is activated during image formation.

5. The image forming apparatus according to claim 1, wherein the rotation speed of the fan in an active state of the exhaust air cleaning function is lower than the rotation speed of the fan in an active state of the room air cleaning function.

6. The image forming apparatus according to claim 1, wherein there are a plurality of options selectable as an air flow rate for the room air cleaning function.

7. The image forming apparatus according to claim 6, wherein the control unit adjusts the air flow rate for the room air cleaning function by adjusting the rotation speed of the fan in accordance with the air flow rate selected from the options.

8. The image forming apparatus according to claim 1, wherein the room air cleaning function is activated when a predetermined period of time elapses after completion of image formation.

9. The image forming apparatus according to claim 1, wherein the room air cleaning function can be activated at a user's option.

10. The image forming apparatus according to claim 1, wherein the room air cleaning function is activated and inactivated repeatedly at predetermined time intervals.

11. The image forming apparatus according to claim 1, further comprising a clock, wherein the room air cleaning function is not activated during predetermined hours.

12. The image forming apparatus according to claim 1, wherein:

the switching member is an apparatus exhaust air valve provided in the first flow path and a room air inlet valve provided in the second flow path;

in the active state of the exhaust air cleaning function, the apparatus exhaust air valve is open, and the room air inlet valve is closed; and in the active state of the room air cleaning function, the apparatus exhaust air valve is closed, and the room air inlet valve is open.

13. The image forming apparatus according to claim 1, wherein the switching member is driven by a motor.

14. The image forming apparatus according to claim 1, wherein the switching member is driven by a force generated by a negative pressure generated by the fan.

15. The image forming apparatus according to claim 12, wherein:

the apparatus exhaust air valve includes a first closure plate capable of opening and closing the first air flow path, and a first spring applying a force in a predetermined direction to the first closure plate;

the room air inlet valve includes a second closure plate capable of opening and closing the second air flow path, and a second spring applying a force in a predetermined direction to the second closure plate;

the first spring and the second spring are configured such that when a negative pressure greater than a predetermined degree is generated in the common use space in the exhaust air duct by operation of the fan, a force generated by the negative pressure overcomes the force applied from the first spring to the first closure plate and the force applied from the second spring to the second closure plate.

16. The image forming apparatus according to claim 15, wherein the negative pressure generated by the fan in the active state of the room air cleaning function is greater than the negative pressure generated by the fan in the active state of the exhaust air cleaning function.

17. The image forming apparatus according to claim 1, wherein a second filter is provided in the first air flow path or in the second air flow path.

18. The image forming apparatus according to claim 1, further comprising:

an image forming section configured to form a toner image on a sheet;

a fixing device configured to fix the toner image formed by the image forming section on the sheet; and a setting section configured to set the rotation speed of the fan in the active state of the room air cleaning function to a first speed, a second speed higher than the first speed or a third speed higher than the second speed, wherein when the image forming section or the fixing device starts operating, the control unit controls the switching member such that the exhaust air duct forms the first air flow path for the exhaust air cleaning function, and sets the rotation speed of the fan to a fourth speed lower than the second speed.

19. An image forming apparatus comprising:

an image forming section configured to form a toner image on a sheet;

a fixing device configured to fix the toner image formed by the image forming section on the sheet;

a filter;

a first duct configured to lead air around the image forming section and the fixing device to the filter;

a second duct configured to lead air outside the image forming apparatus to the filter;

a fan connected to the first duct and the second duct, the fan configured to cause an air flow in the duct;

a switching member configured to switch the air flow caused by the fan to an exhaust air cleaning state wherein air flows mainly from the first duct to the filter or to a room air cleaning state wherein air flows mainly from the second duct to the filter;

a setting section configured to set a rotation speed of the fan to a first speed, a second speed higher than the first speed or a third speed higher than the second speed; and a control unit configured to drive the fan in accordance with information sent from the setting section, and, when the image forming section or the fixing device starts operating, to control the switching member and the fan such that the air flow caused by the fan is switched from the room air cleaning state to the exhaust air cleaning state and such that the fan rotates at a fourth speed lower than the second speed.

20. The image forming apparatus according to claim 19, wherein when the image forming section and the fixing device stop operating, the control unit controls the switching member and the fan such that the air flow caused by the fan is switched from the exhaust air cleaning state to the room air cleaning state and such that the fan rotates at a speed set at the setting section.

* * * * *